United States Patent [19]

Neal et al.

[11] 4,087,292

[45] May 2, 1978

[54] TITANIUM BASE ALLOY

[75] Inventors: Donald Francis Neal, Whittington, near Lichfield; Paul Addyman Blenkinsop, Sutton Coldfield, both of England

[73] Assignee: Imperial Metal Industries (Kynoch) Limited, Birmingham, England

[21] Appl. No.: 683,948

[22] Filed: May 6, 1976

[30] Foreign Application Priority Data

May 7, 1975 United Kingdom ..... 19130/75

[51] Int. Cl.[2] ..... C22C 14/00

[52] U.S. Cl. ..... 148/32.5; 75/175.5; 148/32; 148/133; 148/158

[58] Field of Search ..... 75/175.5; 148/32, 158, 148/32.5, 133

[56] References Cited

U.S. PATENT DOCUMENTS

| | | | |
|---|---|---|---|
| 3,619,184 | 11/1971 | Bomberger, Jr. et al. | 75/175.5 |
| 3,666,453 | 5/1972 | Goosey | 75/175.5 |

FOREIGN PATENT DOCUMENTS

| | | | |
|---|---|---|---|
| 1,913,142 | 10/1969 | Germany | 75/175.5 |
| 2,224,279 | 11/1972 | Germany | 75/175.5 |
| 2,316,891 | 10/1973 | Germany | 75/175.5 |
| 340,633 | 10/1959 | Switzerland | 75/175.5 |
| 757,383 | 9/1956 | United Kingdom | 75/175.5 |
| 1,208,319 | 10/1970 | United Kingdom | 75/175.5 |
| 1,124,114 | 8/1968 | United Kingdom | 75/175.5 |

*Primary Examiner*—Arthur J. Steiner

*Attorney, Agent, or Firm*—Cushman, Darby & Cushman

[57] ABSTRACT

A titanium base alloy for aeronautical use having good high temperature creep properties and being oxidation-resistant, the alloy being 5–6wt% aluminum, 2½–4½wt% tin, 2–4wt% zirconium, 0.75–1.25wt% niobium, 0.1–0.6wt% molybdenum, 0.2–0.4wt% silicon, balance titanium, apart from incidental impurities. The alloy may be beta heat treated and aged, optionally with an intermediate heat treatment before the aging.

9 Claims, 6 Drawing Figures

TITANIUM BASE ALLOY

BACKGROUND OF THE INVENTION

This invention relates to titanium alloys and has particular reference to titanium alloys intended for use in conditions of high temperature and stress such as in aeronautical engines.

Alloys containing 6% aluminum, 5% zirconium, 0.5% molybdenum, 0.25% silicon, balance titanium, have been proposed for use in aircraft engines where service temperatures of up to 520° C are encountered. Such alloys are described for example in British Patent No. 1,208,319. The alloys have to have great dimensional stability in such conditions as tolerances allowed in aircraft engines are very small. The alloys must possess very good high temperature strength and must be resistant to embrittlement on exposure to high temperatures. Embrittlement in this context means loss of ductility measured at room temperature before and after exposure to high temperatures. It is particularly important to note that the measurement after exposure should be taken with the surface of the alloy remaining. One test after exposure can be to measure the properties of the alloy with the oxidised surface removed. In practice, however, this is not sufficiently like real-life conditions since the alloy in use cannot have its surface removed during operation. It is important, therefore, that the alloy be resistant to oxidation and it has been discovered that a particular alloy combination is exceptionally resistant to oxidation as will be described below.

In addition to having oxidation resistance, the alloy must be ductile, it must have a high creep resistance, it must be forgeable, and it must be weldable as welding is frequently used in fabrication of parts made from such alloys. By "weldable" in the present context is meant that articles manufactured from the alloy can be used in the welded condition. It is not sufficient merely to be able to stick two pieces of metal together; the alloy in the post-welded condition after a suitable heat treatment must have properties virtually indistinguishable from the alloy in the pre-welded condition. The alloy must also be resistant to fatigue and must of course have a relatively high tensile strength.

Commercially useful alloys must also be resistant to ordering and the alloys must in use be stable at elevated temperatures. The alloys with which the present invention is concerned have a very fine alpha plate structure and precipitation is normally found at the alpha plate boundaries. The precipitation is thought to be influenced by the levels of molybdenum and niobium. The precipitation limits the application of components formed from the alloy both in terms of the temperature of use and the time at temperature. In order that the fatigue initiation characteristics are acceptable the aluminium equivalents in the alloy should be kept as low as possible since this will effect the dislocation behaviour in the alloy.

Improvements in any one or two properties of an alloy can usually be obtained by suitable modification to the composition or to the heat treatment. The difficulty, however, is to obtain these improvements and to maintain or even better the remaining properties of the alloy. For example, the tensile strength of an alloy can normally be improved by the addition of alloying elements, but this normally reduces the ductility of the alloy. The present invention is concerned with an alloy which has an acceptable balance of properties throughout the entire range.

SUMMARY OF THE INVENTION

By the present invention, there is provided a titanium alloy comprising 5–6wt% aluminium, 2.5–4.5wt% tin, 2–4wt% zirconium, 0.75–1.25 wt% niobium, 0.1–0.6wt% molybdenum, 0.2–0.4wt% silicon, balance titanium, apart from incidental impurities.

The chromium, nickel, and manganese content of the alloy may be individually no greater than 0.02wt%. The maximum oxygen content is preferably 1500ppm content preferred.

The molybdenum content may be in the range 0.15–0.4wt%. The alloy may more specifically contain 5.4wt% aluminium, 3.5wt% tin, 3wt% zirconium, 1wt% niobium, 0.3wt% molybdenum and 0.3wt% silicon apart from incidental impurities.

The alloy may be heat treated by soaking in the beta field at 1010° C to 1050° C, preferably 1035° C, cooling to ambient temperature and then ageing for a period of about 24 hours at a temperature in the range 500°–600° C. There may be an intermediate heat treatment of soaking in the range 800°–900° C, preferably at 850° C before the ageing treatment.

The present invention further provides an aircraft component, particularly an aircraft engine component, formed of the alloy specified above.

BRIEF DESCRIPTION OF THE DRAWINGS

By way of example, embodiments of the present invention will now be described with reference to the accompanying drawings, of which.

DESCRIPTION OF THE PREFERRED EMBODIMENTS

Figure 1:
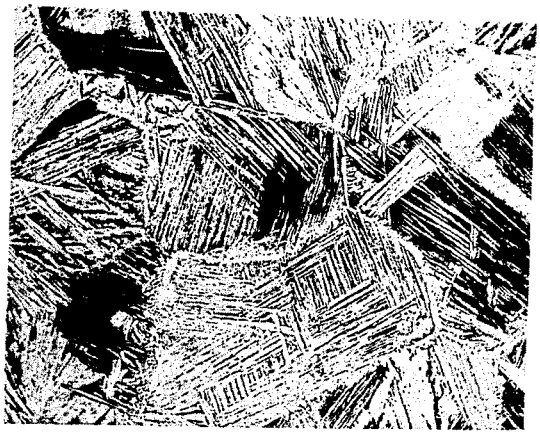
FIG. 1 is a photomicrograph of a prior art alloy.

The alloys of the present invention, and in particular the preferred alloy composition, have been critically selected to give good creep resistance, good tensile ductility, good post-creep ductility, good oxidation resistance and a refined structure. The combination of good tensile ductility and post-creep ductility also leads to improved low cycle fatigue properties, particularly post-exposure low cycle fatigue properties. Further, the alloys are also weldable.

It has also been found that the particular alloy of the invention is very stable in that it resists ordering and has a very small amount of precipitation at the alpha plate boundary within the matrix which enables components manufactured from the alloy to be used for long periods of time at high temperatures.

In addition to the prior art alloys mentioned above, U.S. Pat. No. 3,619,184 refers to the alloy composition titanium 6% aluminum 3% tin 3% zirconium 0.8% molybdenum 0.3% silicon 1.3% niobium.

As will be shown below, the post-creep properties of the relatively high molybdenum content alloys are worse than the post-creep properties of the lower molybdenum content alloys of the invention.

The prior art alloy 6% aluminium, 3% tin, 3% zirconium, 0.8% molybdenum, 0.3% silicon, 1.3% niobium will also suffer from ordering problems when compared to the alloy of the invention. Although the aluminium equivalent of this alloy is nominally 6 + 3/3 (for the tin) + 3/6 (for the zirconium) i.e., 7.5, this ignors the oxygen content of the alloy in the aluminium equivalent equation. The aluminium equivalent of oxygen is 10 and since the oxygen content of these alloys in commercial practice is of the order of 1,000ppm, this means that oxygen is equivalent to approximately 1% of aluminum. In the particular prior art alloy, therefore, the total oxygen equivalent is 8.5. With the specific alloy of the invention, however, the aluminium equivalent is 5.4 + 3.5/3 + 3/6 + 0.1/10 = 8.07. This means that the alloy of the invention is significantly more stable than the specific prior art alloy.

A series of alloys of 5.5% aluminium, 2.5% tin, 3% zirconium, 1% niobium, 0.3% silicon were melted with the following additions of molybdenum — 0%, 0.1%, 0.2%, 0.4% and 0.8%. All percentages mentioned herein are weight percentages. The alloys were analysed after manufacture and the analysis of the material is given in Table I.

TABLE I

| Sample Number | Al % | Sn % | Zr % | Nb % | Mo % | Si % | $O_2$ % |
|---|---|---|---|---|---|---|---|
| | | | ANALYSIS | | | | |
| 1 | 5.30 | 2.40 | 3.15 | 0.99 | — | 0.30 | 0.105 |
| 2 | 5.28 | 2.46 | 3.13 | 0.98 | 0.11 | 0.31 | 0.120 |
| 3 | 5.50 | 2.50 | 3.09 | 1.00 | 0.21 | 0.32 | 0.10 |
| 4 | 5.36 | 2.54 | 3.13 | 1.02 | 0.42 | 0.31 | 0.115 |
| 5 | 5.61 | 2.58 | 3.24 | 1.04 | 0.84 | 0.32 | 0.115 |

The samples were each rolled to rod at 1050° C and heat treated at 25° C above the beta transus for each alloy. From this solution treatment, the alloys were slow cooled in air and then aged for 24 hours at 550° C. Samples of each composition were tensile tested, and were creep tested at 540° C for 300 hours under a stress of 310N /mm². Additionally, post-creep tensile data with the surface retained were measured. A heat treatment error was detected in sample No. 5 which produced an alpha-beta structure. This was not detected after tensile testing but before creep testing, so that the creep sample was re-heat treated in the beta phase field. The tensile creep and post-creep tensile data are given in Table II.

TABLE II

TENSILE, CREEP AND POST-CREEP TENSILE DATA

| Sample Number/ Composition | Tensile-Pre or Post-Creep | % T.P.S. Crrep Data 100 hr 540° C 310 N.mm$^{-2}$ | 300 hr 540° C 310 N.mm$^{-2}$ | Tensile Properties 0.1% PS N.mm$^{-2}$ | 0.2% PS N.mm$^{-2}$ | U.T.S. N.mm$^{-2}$ | El 4 √A % | El 5D % | R in A % |
|---|---|---|---|---|---|---|---|---|---|
| 1 | Pre | | | 827 | 847 | 946 | 18 | 14 | 29.5 |
| Base + (0% Mo) | Post | 0.170 | 0.608 | 876 | 897 | 950 | 14 | 10.5 | 22 |
| 2 | Pre | | | 843 | 872 | 990 | 18 | 14 | 29 |
| Base + (0.1% Mo) | Post | 0.067 | 0.199 | 899 | 917 | 911 | 13.5 | 10 | 19 |
| 3 | Pre | | | 843 | 883 | 1015 | 18.5 | 14 | 29.5 |
| Base + (0.2% Mo) | Post | 0.092 | 0.198 | 913 | 933 | 1013 | 12 | 10 | 16 |
| 4 | Pre | | | 832 | 867 | 994 | 16 | 12 | 28 |
| Base + (0.4% Mo) | Post | 0.096 | 0.207 | 899 | 914 | 1000 | 10 | 7.5 | 16 |
| 5 | Pre | | | 856 | 896 | 1061 | 18 | 14 | 27.5(1) |
| Base + (0.8% Mo) | Post | 0.104 | 0.232 | 926 | 949 | 1029 | 7 | 4.5 | (1)8.5(2) |

(1)Alpha beta heat treated in error.
(2)Re-heat treated (beta) before creep testing.

In table II and in all subsequent tables, the elongation 4√A refers to the elongation on a gauge length of 4 × the square root of the area. The E1 5D refers to the elongation on a gauge length of 5 × the diameter.

It can be seen that after 0.1% molybdenum, there is no further significant increase in the strength of the alloy. It can be seen that there is an improvement in creep resistance on initial addition of molybdenum and a gradual degradation thereafter. The post-creep ductility properties with higher contents of molybdenum show a rapid reduction. Thus, the 0.1, 0.2 and 0.4 molybdenum content alloys have a reduction in area of 19 to 16% whereas the 0.8% molybdenum has a reduction in area of only 8.5%. It can be similarly seen that the elongation drops rapidly when the molybdenum content reaches 0.8% and for this reason the 0.8% molybdenum alloy is unsuitable because low post-creep ductility properties are detrimental to low cycle fatigue properties.

The effects of tin were then tested on an alloy base 5.5% aluminium, 2% zirconium, 1% niobium, 0.5% molybdenum, 0.25% silicon. The compositions examined were the base with 0%, 1%, 3% and 6% tin. The heat treatment given to the alloys was ¾ hour at 1050° C in the beta field, slow air cooling and then 24 hours ageing at 550° C. By way of example, the 3% tin alloy was compared with a tin-free alloy 6% aluminium 5% zirconium 0.5% molybdenum, 0.3% silicon of the type described in British Patent No. 1,208,319.

Table III shows the tensile properties on the series of 4 alloys with 0, 1, 3 and 6% tin as mentioned above.

TABLE III

| Tin Addition % | 540° C/310 N/mm² Creep Data 100 hr T.P.S. % | 300 hr T.P.S. % | TENSILE PROPERTIES 0.1% PS N/mm² | 0.2% PS N/mm² | U.T.S. N/mm² | El 4 √A % | El 5D % | R in A % |
|---|---|---|---|---|---|---|---|---|
| 0 | — | — | 749 | 779 | 896 | 12.5 | 10 | 27.5 |
| | 0.322 | 1.24 | 820 | 834 | 896 | 10 | 8.5 | 12.5 |
| 1 | — | — | 764 | 784 | 909 | 15.5 | 12 | 32 |
| | 0.283 | 0.799 | 804* | 824 | 892 | 6.5 | 5 | 8 |
| 3 | — | — | 752 | 784 | 943 | 12.5 | 10.5 | 25.5 |

TABLE III-continued

| Tin Addition % | 540° C/310 N/mm² Creep Data 100 hr T.P.S. % | 300 hr T.P.S. % | TENSILE PROPERTIES 0.1% PS N/mm² | 0.2% PS N/mm² | U.T.S. N/mm² | El 4 √A % | El 5D % | R in A % |
|---|---|---|---|---|---|---|---|---|
| | 0.150 | 0.353 | 845 | 864 | 964 | 9 | 7.5 | 15 |
| 6 | — | — | 814 | 850 | 992 | 13.5 | 10.5 | 27.5 |
| | 0.074 | 0.139 | 873 | 893 | 1005 | 9.5 | 8 | 12.5 |

*Slight premature failure due to surface defect

In Table IV, the notch tensile properties for the four alloys are given.

TABLE IV

| Tin Addition % | NOTCH TENSILE PROPERTIES Unexposed Control N/mm² | Exposed 540° C/300hr 310N/mm² surface Removed N/mm² | Exposed 540° C/300hr 310N/mm² surface Retained N/mm² |
|---|---|---|---|
| 0 | 1370 | 1438 | 1386 |
| 1 | 1492 | 1463 | 1470 |
| 3 | 1542 | 1556 | 1509 |
| 6 | 1533 | 1524 | 1425 |

It can be seen that the addition of tin increased both the proof and ultimate strength whilst the ductility remained constant. The notch tensile strength increased and reached a maximum around 3% tin but the creep resistance improved continually. Since the notch tensile properties peak at about 3% tin, tin in excess of this, although giving increased strength, had concomitant notch tensile ductility losses which proved to be unacceptable.

A further series of alloys were then melted to determine the effect of molybdenum on the base Ti—5.5% Al—3.5% Sn—3% Zr—1% Nb — 0.3% Si with 0%, 0.1%, 0.25%, 0.5%, 0.75% and 1% molybdenum. The samples were melted as 150 gramme buttons and rolled at 1,050° C to 12mm² bar. An analysis of the samples is given in Table V.

TABLE V

| Sample Number | Chemical Analysis Al % | Sn % | Zr % | Nb % | Mo % | Si % | $O_2$ % | Fe % |
|---|---|---|---|---|---|---|---|---|
| 839 | 5.43 | 3.45 | 3.08 | 0.98 | — | 0.32 | 0.105 | 0.015 |
| 840 | 5.47 | 3.45 | 3.05 | 0.98 | 0.10 | 0.32 | 0.100 | 0.021 |
| 841 | 5.50 | 3.48 | 3.05 | 0.98 | 0.25 | 0.32 | 0.100 | 0.022 |
| 842 | 5.47 | 3.38 | 3.03 | 0.98 | 0.46 | 0.32 | 0.105 | 0.031 |
| 843 | 5.50 | 3.45 | 3.04 | 0.98 | 0.77 | 0.29 | 0.115 | 0.024 |
| 844 | 5.41 | 3.45 | 3.06 | 1.01 | 0.99 | 0.31 | 0.130 | 0.027 |

All of the bars were solution treated at 1,035° C, air cooled and examined metallographically to ensure complete beta solutioning. This was followed by ageing at 550° C for 24 hours and air cooling. Tensile tests were carried out on samples, the 0.1% proof stress, the 0.2% proof stress, the ultimate tensile stress, the elongation on engaged length of 4 A thereon a gauge length of 5D were measured. The reduction in area was also measured. Samples were also given creep tests at 540° C under a stress of 300N.mm² for 100 hours and 300 hours. Post-creep samples were also subsequently given tensile tests. The results are given in table VI and are shown graphically in FIGS. 4, 5 and 6. The samples were also metallographically examined.

TABLE VI

| Sample Number and and Mo Level | Pre or Post Creep Tensile | Creep T.P.S. 540° C/300 N.mm⁻² 100 hr % | 300 hr % | Tensile Properties 0.1%PS N.mm⁻² | 0.2%PS N.mm⁻² | UTS N.mm⁻² | El4√A % | EL5D % | R in A % |
|---|---|---|---|---|---|---|---|---|---|
| 839 | Pre | — | — | 834 | 851 | 962 | 13 | 11 | 21 |
| 0% Mo | Post | 0.107 | 0.272 | 881 | 902 | 993 | 6.5 | 5 | 10 |
| 840 | Pre | — | — | 863 | 893 | 1010 | 16.5 | 13.5 | 28 |
| 0.1% Mo | Post | 0.086 | 0.259 | 903 | 923 | 1014 | 6 | 5 | 7 |
| 841 | Pre | — | — | 870 | 890 | 1017 | 16 | 13 | 23.5 |
| 0.25% Mo | Post | 0.053 | 0.129 | 915 | 931 | 1031 | 8 | 7.5 | 10 |
| 842 | Pre | — | — | 866 | 899 | 1053 | 13 | 11 | 21 |
| 0.5% Mo | Post | 0.065 | 0.123 | 907 | 924 | 1034 | 8 | 6.5 | 13 |
| 843 | Pre | — | — | 843 | 874 | 1039 | 11 | 8.5 | 23 |
| 0.75% Mo | Post | 0.064 | 0.128 | 929 | 951 | 1069 | 8 | 7 | 12 |
| 844 | Pre | — | — | 889 | 921 | 1091 | 11.5 | 9.5 | 20 |
| 1.0% Mo | Post | 0.088 | 0.154 | 948 | 967 | 1082 | 6 | 5 | 8 |

It can be seen that the tensile ductility of the alloy base increases with addition of molybdenum and reaches a maximum at around 0.1 to 0.25% molybdenum reducing gradually thereafter. This is believed to be related to the solubility of molybdenum in alpha titanium.

The tensile strength and proof strength increase up to about 0.25% molybdenum but level out or drop beyond approximately 0.7% molybdenum. There is a further rise at 1% molybdenum. It is thought that this variation is due to an initial increase in strength of the alpha phase as molybdenum goes into solution to its maximum solubility. A slight reduction follows as small amounts of "soft" beta phase is produced. The increase at around 1% molybdenum occurs as alpha precipitation occurs in the larger amounts of beta phase now formed. The creep resistance peaks at approximately 0.25% molybdenum and gradually decreases as molybdenum is increased beyond this point. The increase is though to relate to the solubility of molybdenum in alpha titanium, which improves creep resistance by solute drag and the gradual reduction is due to the formation of beta phase which is less creep resistant.

Stability in terms of post creep ductility losses and proof stress increases, again attain their best levels at around 0.25% to 0.3% molybdenum and decrease thereafter.

From metallurgical examination, refinement of the transformation product is achieved by additions of up to 0.25% molybdenum. Some further refinement does occur at higher molybdenum contents, but the change is small compared with that attained by the addition of 0.25% molybdenum. The actual form of the transformation product varies with the cooling rate but at any given cooling rate a similar range of microstructures is expected.

It can be seen that molybdenum has a critical effect on the properties of the base material and taken together the properties are best in the range 0.25% to 0.3%.

Figure 2:
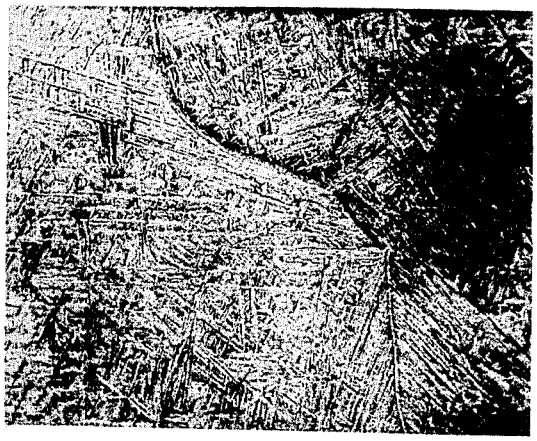
FIG. 2 is a photomicrograph of an alloy in accordance with the invention.

In FIGS. 1 and 2, there is shown the microstructure at a magnification of 250 × of the alloy 5.5% aluminium 3% zirconium 1% niobium 0.25% molybdenum 0.3% silicon 3.5% tin (FIG. 2) and the alloy titanium 6% aluminium 5% zirconium 0.5% molybdenum 0.3% silicon (FIG. 1). It can be seen that a very much finer transformation product was obtained in the alloy in accordance with the invention which is much better than the coarser structure of the prior art alloy although this prior art alloy is itself normally acceptable. One major advantage of the finer transformation product is that it is possible to air cool the alloy rather than oil quench the alloy of the prior art to obtain the same transformation structure. Air cooling gives much lower internal stresses than oil quenching which is of course a major advantage. It is also possible to obtain the finer structure in the alloy of the invention when compared with the prior art alloy.

Silicon additions are well-known to increase the creep resistance of titanium alloys and also to refine the grain size which increases the ductility of the alloy. However, too much silicon can lead to segragation and silicides in the alloy and the silicon tends not to dissolve. About 0.3% is the upper limit for silicon in most titanium alloys.

The aluminium content should be as high as possible to obtain maximum tensile properties without having an ordering problem. Since ordering, a well-known phenomenon in titanium alloys, occurs at an aluminium equivalent of about 8% (3% tin = 1% aluminium and 6% Zr = 1% Al) this effectively limits the aluminium content to about 6% maximum if ordering is to be avoided.

Zirconium is also a strengthening element and 3% zirconium is used in the alloy for optimum strength, creep resistance and stability.

Figure 3:
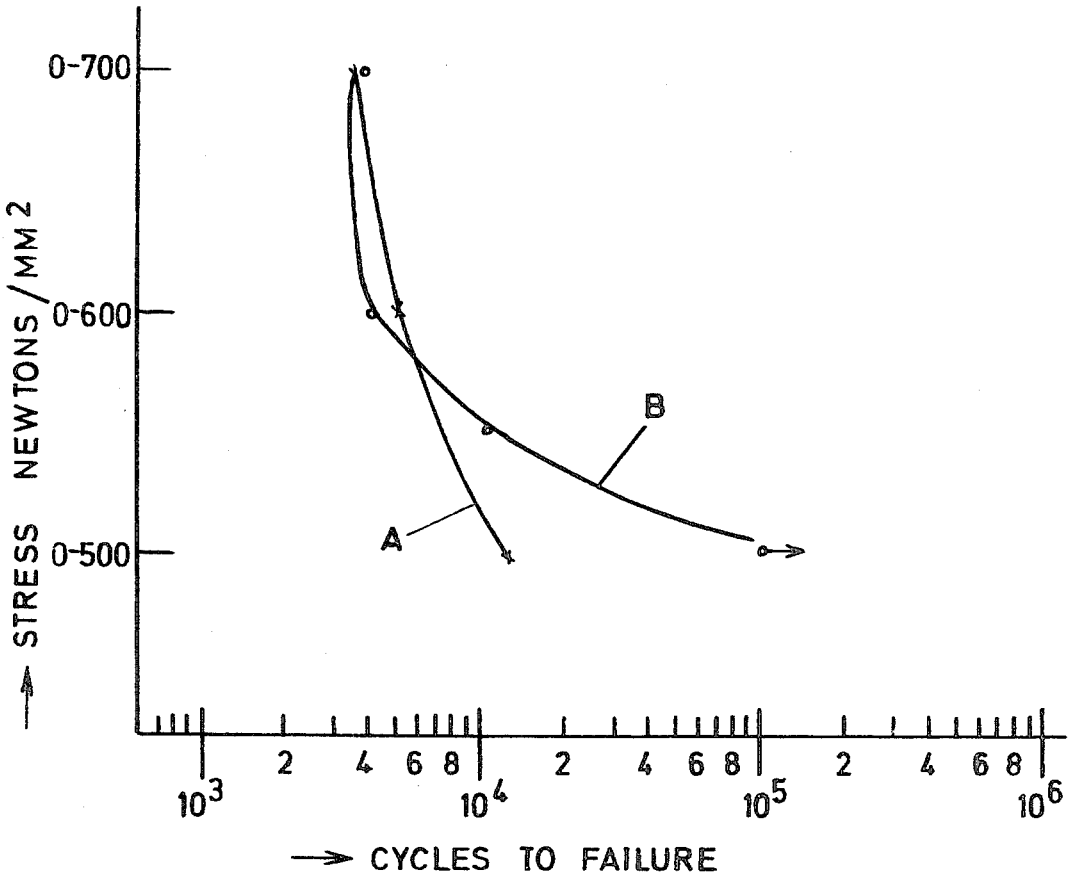
FIG. 3 is a graph showing exposed low cycle fatigue properties of a prior art alloy and an alloy in accordance with the present invention.

In FIG. 3, there is shown the difference between the low cycle fatigue properties at 300° C of the alloy titanium 6% aluminium 5% zirconium 0.5% molybdenum 0.3% silicon (alloy A) with the alloy 5.5% aluminium 3.5% tin 3% zirconium 1% niobium 0.5% molybdenum 0.3% silicon (alloy B) in accordance with the invention. The alloy B had not failed after $10^5$ cycles. Both alloys had been heat treated at 1050° C in the beta field, then air cooled and aged at 550° C for 24 hours. The low cycle fatigue properties were measured after exposure at 540° C for 300 hours at a stress of 310N/mm$^2$. It can be seen that the low cycle fatigue properties of the alloy in accordance with the invention are superior to the prior art alloy at low stresses, ie 500 N/mm$^2$, which is in the stress region within which the alloy operates in use.

Figure 4:
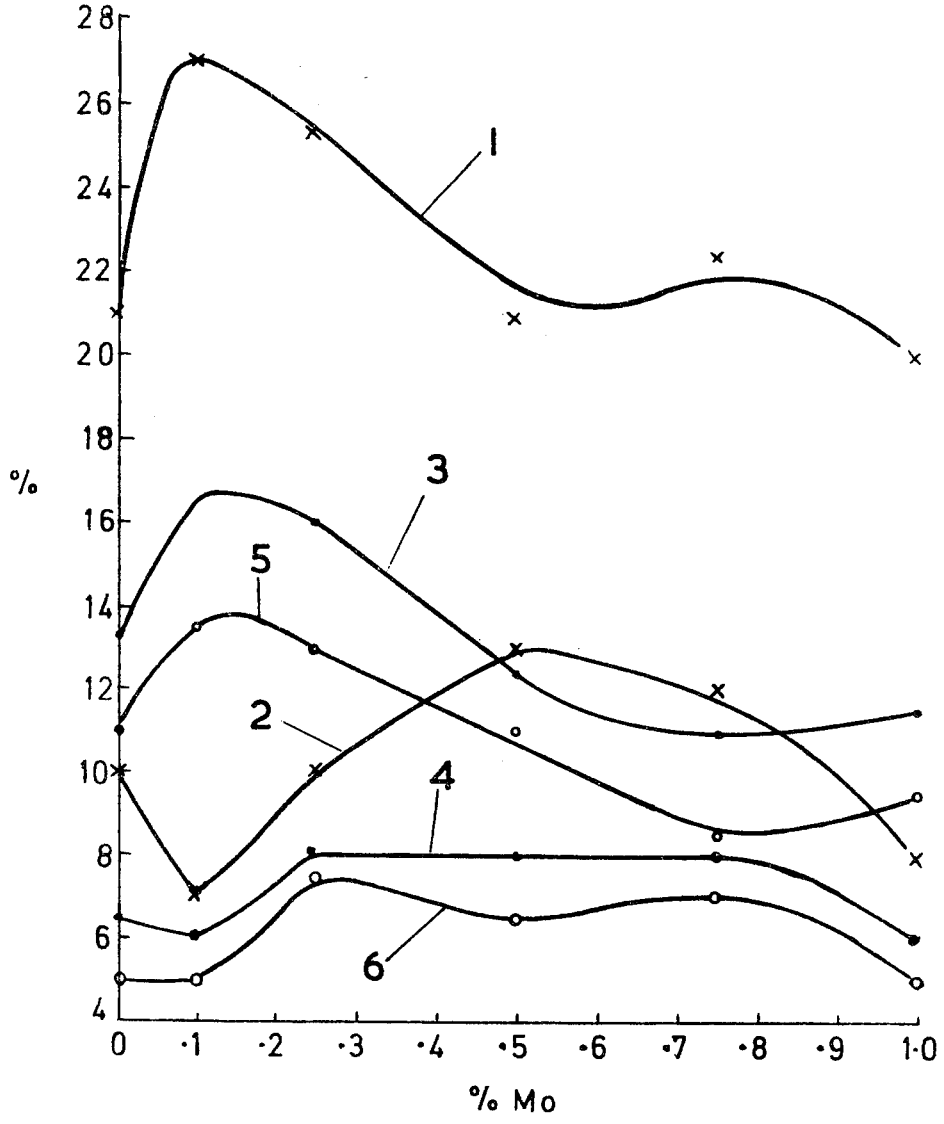
FIG. 4 is a graph showing elongation against percentage molybdenum.

FIG. 4 Line 1 represents the reduction in area for the samples tested in the pre-creep condition. Line 2 represents the reduction in area in the post-creep condition. Line 3 is the elongation on a gauge length of $4\sqrt{A}$ in the pre-creep condition, and Line 4 in the post-creep condition. Similarly Line 5 is the elongation on a gauge length of 5D in the pre-creep condition and Line 6 in the post-creep condition. In all cases the properties are given in terms of percent against molybdenum varying between 0% and 1%. These graphs are taken from the information in Table VI.

Figure 5:
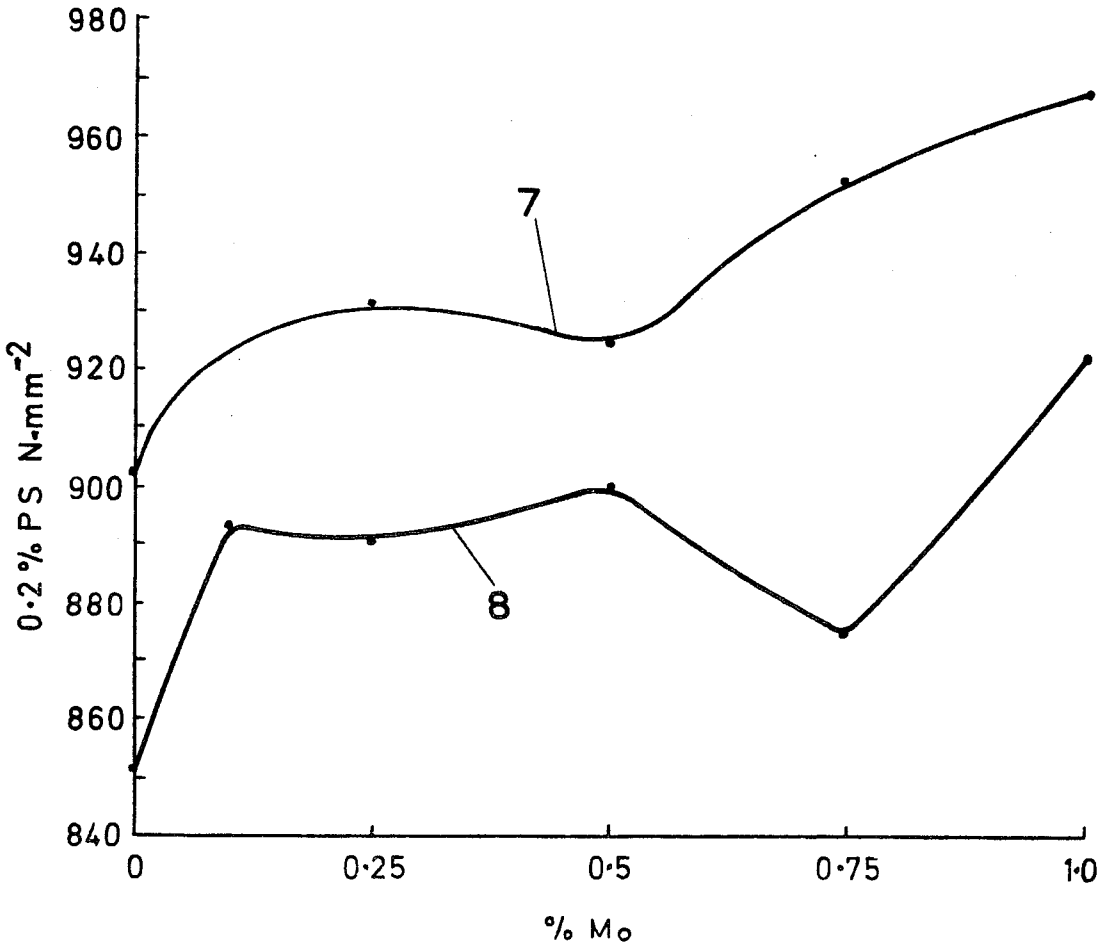
FIG. 5 is a graph showing the effect of molybdenum on the 0.2% proof stress.

FIG. 5 shows the 0.2% proof stress against molybdenum content, Line 7 representing the measurements in the exposed condition, whereas Line 8 relates to measurements in the unexposed condition.

Figure 6:
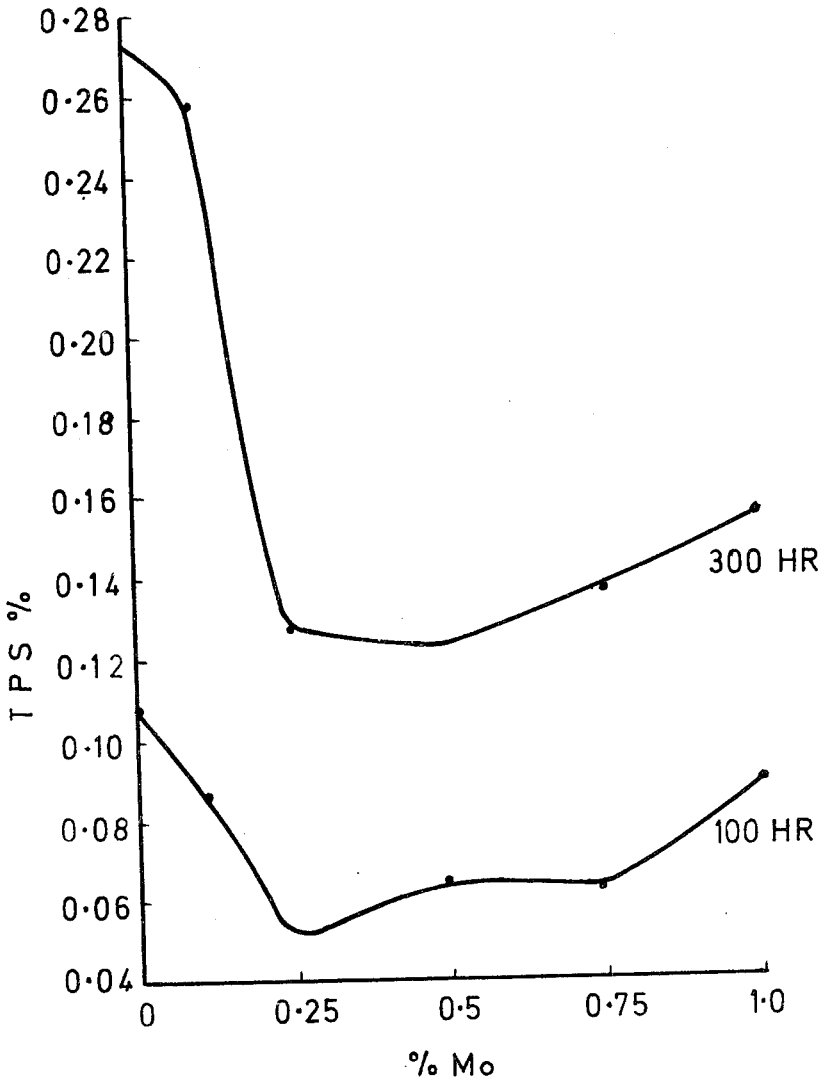
FIG. 6 is a graph of total plastic strain against molybdenum and creep taking place at 540° C at an applied stress of 300 N.mm-2.

FIG. 6 shows graphically the creep data given in Table VI and it can be seen that the total plastic strain is at a minimum for molybdenum contents within the range 0.25% to 0.75%. Clearly, the lower the plastic strain the better, as the more resistant the material is to creep stress.

Comparing specifically the alloy of the invention in its preferred composition of 5.4% aluminium, 3.5% tin, 3% zirconium, 1% niobium, 0.25% to 0.3% molybdeaum and .3% silicon, with the specific alloy of the prior art, namely, 6% aluminum, 3% tin, 3% zirconium, 0.8% molybdenum, 0.3% silicon, 1.3% niobium, the following differences can be noticed :

1. Ordering will be a problem in the prior art alloy which will result in instability problems which will not be experienced for the specific alloy of the invention.
2. Precipitation effects in the alpha plate boundaries will be greater in the prior art alloy than in the alloy of the invention because of the increased molybdenum and niobium levels in the prior art alloy. This precipitation will limit the application of any component made from the prior art alloy both in terms of its temperature of use and in terms of the time at temperature.
3. The creep resistance properties of the alloy of the invention will be better than in the prior art alloy at temperatures greater than 520° C.
4. Because of the low niobium and molybdenum contents in the alloy of the invention when compared to the prior art alloy, and hence the lower level precipitation, it is possible to stress relieve components at higher temperatures made from the alloy of the invention when compared to the prior art alloy.
5. The oxidation resistance properties of the 2 alloys will differ.
6. The notched properties, for example fatigue and impact, will be better in the alloy of the invention.
7. The fracture toughness of the alloy of the invention will be better than the prior art alloy, principally because of the lower UTS of the alloy of the invention.
8. The differences in the aluminium equivalents between the alloy of the invention and the prior art alloy will mean differences in dislocation behaviour between the two alloys. This factor is likely to be important in fatigue initiation characteristics and in fracture characteristics and will favour the alloy of the invention.
9. The weldability of the alloys will vary.
10. Lower molybdenum and lower niobium contents help reduce the density of the alloy which is important for items subjected to centrifugal forces.

We claim:

1. A titanium alloy consisting essentially of 5.4 to 5.5wt% aluminium, 3.5wt% tin, 3wt% zirconium, 1wt% niobium, 0.25 to 0.3wt% molybdenum, 0.3wt% silicon, balance titanium, apart from incidental impurities, the alloy being heat treated by soaking in the beta field at 1010° C to 1050° C, cooling to ambient temperature and then ageing for a period of about 24 hours at a temperature in the range 500° to 600° C.

2. An alloy, as claimed in claim 1, in which the chromium, nickel and manganese content of the alloy individually are no greater than 0.02wt%.

3. The alloy of claim 1 in which the oxygen content is less than 1,500 ppm.

4. The alloy of claim 3 in which the oxygen content is in the range 1,000–1,200 ppm.

5. The alloy, as claimed in claim 1 in which the aluminium content is 5.4wt% and the molybdenum is 0.3wt%.

6. An alloy, as claimed in claim 16, in which the heat treatment temperature in the beta field takes place at 1,035° C.

7. An alloy, as claimed in claim 1, in which there is an intermediate heat treatment comprising soaking in the range 800°/900° C, before the ageing treatment.

8. The alloy of claim 7 in which the intermediate heat treatment takes place at 850° C.

9. An aircraft engine component for use at elevated temperature manufactured from the alloy of claim 1.

* * * * *